US008696052B2

(12) United States Patent
Zhu

(10) Patent No.: US 8,696,052 B2
(45) Date of Patent: Apr. 15, 2014

(54) FOLDING CHAIR

(75) Inventor: Shou Qiang Zhu, Ontario, CA (US)

(73) Assignee: IP Power Holdings Limited, Hong Kong (CN)

( * ) Notice: Subject to any disclaimer, the term of this patent is extended or adjusted under 35 U.S.C. 154(b) by 30 days.

(21) Appl. No.: 13/545,194

(22) Filed: Jul. 10, 2012

(65) Prior Publication Data

US 2014/0015287 A1 Jan. 16, 2014

(51) Int. Cl.
*A47C 4/28* (2006.01)

(52) U.S. Cl.
USPC ..... 297/36; 297/37; 297/41; 297/45

(58) Field of Classification Search
USPC ..... 297/35, 36, 37, 41, 45
See application file for complete search history.

(56) References Cited

U.S. PATENT DOCUMENTS

| | | | | |
|---|---|---|---|---|
| 1,895,115 | A * | 1/1933 | Williams | 297/45 |
| 4,243,263 | A * | 1/1981 | Thiboutot | 297/45 |
| 5,058,950 | A * | 10/1991 | Mann | 297/45 |
| 7,607,725 | B2 * | 10/2009 | Dickie et al. | 297/45 X |

* cited by examiner

*Primary Examiner* — Anthony D Barfield
(74) *Attorney, Agent, or Firm* — Che-Yang Chen; Law Office of Michael Chen

(57) ABSTRACT

A folding chair may include an upper frame, two armrests, two side frames, a front linking unit and a rear linking unit. When the user moves the armrests down to start chair folding process, the front linking unit and rear linking unit start to shrink and bring the side frames closer to each other. In the mean time, two side connecting rods are driven to bring the upper frame to moves down and further squeeze a seat fabric into a space between two side frames to form a compact structure of the folding chair. The size of the folding chair can be determined by extended length of the front linking unit and a rear linking unit. The folding chair proposed in the present invention is comfortable and stable for the user to sit, and all elements of the folding chair can be easily and closely folded into a compact size.

15 Claims, 11 Drawing Sheets

FOLDING CHAIR

FIELD OF THE INVENTION

The present invention relates to a folding chair, and more particularly to a folding chair having two outside frames and the folding chair can be folded or collapsed to occupy a minimum amount of space defined by the outside frames.

BACKGROUND OF THE INVENTION

In recent years, more and more people love outdoor and recreational activities such as camping, field trips, or Bar-B-Q during their free time because many people may endure high pressure at work, and have accumulated a lot of tension and stress. Not only can these outdoor activities help people release the stress, but also improve quality of life. Since most places for abovementioned outdoor activities do not have all the facilities, it may be more convenient for people to bring some outdoor furniture such as folding chairs, tables, etc. Thus, making the outdoor furniture light and easy to carry around become important issues for outdoor furniture manufacturers.

For many years, folding chairs are made by wood, however, these wooden folding chairs are usually heavy and lack long-term durability. Also, the wooden chairs are difficult to effectively stack together. Recently, folding chairs usually have metal chair frames that can be bent to desired shapes and coupled with seat pads, and they are generally light weight and portable. When not in use, these folding chairs can be folded and the folded chairs are easily stacked for storage or transportation.

U.S. Pat. No. 6,305,742 to Spendlove at al. discloses a folding chair having a folding mechanism which collapses or folds upon itself to save space, and a safe stopper member for limiting movement of the folding mechanism in the open position to provide a limited opened position, and to resist pinching. FIG. 1*a* shows the folding chair in a fully open status, and the chair can be folded when front legs and rear legs move towards directions A and A' respectively. When the front legs and rear legs touch with each other, the folding chair is at a folded status and reaches its minimum volume as shown in FIG. 1*b*. However, most folding chairs, like the one disclosed by Spendlove, do not provide armrests for the user. So, the user may feel tired or uncomfortable if sitting on the folding chair for a long period of time. Moreover, adding armrests to the folding chair may increase the size thereof.

U.S. Pat. No. 6,540,290 to Liu discloses a folding chair that has toggle joints to engage various elements and to function as fulcrums that allow the elements to fold closely with each other, so the chair can be folded to a compact size as shown in FIGS. 2*a* and 2*b*. Moreover, the folding chair has armrests that can be effectively folded as well without significantly increasing the size of the folding chair. However, the folding chair disclosed by Liu may not be stable because when external force is randomly applied to the side frames of the chair, the chair may start to fold and deform.

U.S. Pat. No. 7,758,111 to Chen discloses a folding chair having a supporting backrest and armrests as shown in FIG. 3*a*. The main purpose of the supporting backrest is to enforce the supporting force of the rear leg rods and prevent them from being deformed by the inwardly stress of the backrest unit, and the entire chair structure would be more stabilized. Even though the chair can be folded in to a compact size as shown in FIG. 3*b*, it may take some extra steps such as removing the backrest unit and removing the armrests from their original positions, which may be inconvenient and impractical for the user.

Therefore, there remains a need for a new and improved folding chair that is comfortable and stable for the user to sit, and can be easily folded into a compact size to overcome the problems stated above.

SUMMARY OF THE INVENTION

It is an object of the present invention to provide a folding chair that is comfortable and stable for the user to sit and all elements of the folding chair can be easily collapsed and closely folded into a compact size.

It is another object of the present invention to provide a folding chair having armrests that can be fastened to upper frame of the folding chair to prevent the folding chair from deformation when external force applies.

It is a further object of the present invention to provide a folding chair having an extendable front linking unit and rear linking unit that can be easily driven to extend or shrink to control the distance of side frames of the folding chair and further manage the size thereof.

It is still a further object of the present invention to provide a folding chair that can be easily manufactured, stored and stacked.

In one aspect of the present invention, a folding chair may include an upper frame, two armrests, two side frames, a front linking unit and a rear linking unit. In one embodiment, the upper frame and the side frames are coupled through a plurality of connectors. More particularly, one end of the connector is fixed at the side frames and the other end is pivotally connected with the upper frame, so that the upper frame can move along a "z to x" direction (see FIG. 4) or vice versa on top of the side frames. The armrests are also coupled with the side frames through a plurality of armrest connectors. In one embodiment, two front armrest connectors are disposed at front portions of the side frames to engage two front ends of the armrests, while two rear armrest connectors are disposed at rear portions of the side frames to engage two rear ends of the armrests. Also, the armrests are pivotally connected with the side frames, so that the armrests can move along a "z to y" direction (see FIG. 4) or vice versa. In another embodiment, the upper frame and an upper portion of the side frames are covered by a fabric, which is provided as a backrest on the upper frame and a seat on the upper portion of the side frames.

In one embodiment, the front linking unit includes two first front linking rods, a first front connector, two second front linking rods and a second front connector. The first front linking rods are pivotally connected through the first front connector at one end, and pivotally connected through the front armrest connectors at the other end to form a substantially "V" shaped structure. Similarly, the second front linking rods are pivotally connected through the second front connector at one end, and pivotally connected through two front movable connectors at the other end to form a substantially reverse "V" shaped structure. Furthermore, the "V" shaped structure is also pivotally connected with the reverse "V" shaped structure. More particularly, the first front linking rods are pivotally connected with the second front linking rods at nearly the center thereof. In addition, identical elements and connecting mechanism applies to the rear linking unit.

In another embodiment, the folding chair also includes a pair of front connecting rods, a pair of rear connecting rods and a pair of side connecting rods. The front connecting rods are pivotally connected with front portion of the armrest at one end, and pivotally connected with the front movable connectors at the other end. Likewise, the rear connecting rods are pivotally connected with rear portion of the armrest at one end, and pivotally connected with the rear movable connectors at the other end. The side connecting rods are connected with the upper frame at one end, and connected with the front movable connectors at the other end.

In an exemplary embodiment, when the user moves the armrests down to start the chair folding process, the front linking unit and rear linking unit are driven to shrink and bring the side frames closer to each other. In the mean time, the side connecting rods are driven to bring the upper frame to moves down and further squeeze the fabric into a space between two side frames to form a compact structure of the folding chair.

In still an exemplary embodiment, the folded chair can be restored by first with lifting the armrests to trigger the front and rear connecting rods to bring up the front and rear movable connectors. With the upward movements of the front and rear movable connectors, the front linking unit and rear linking unit can be gradually extended and eventually reach their most extendable length. Meanwhile, the side connecting rods are also triggered by the upward movements of the front and rear movable connectors to lift the upper frame to the upright position and the fabric is tightened to form the backrest and seat on the upper frame. Finally, the armrests are fastened at the upper frame by the fasteners.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1B:
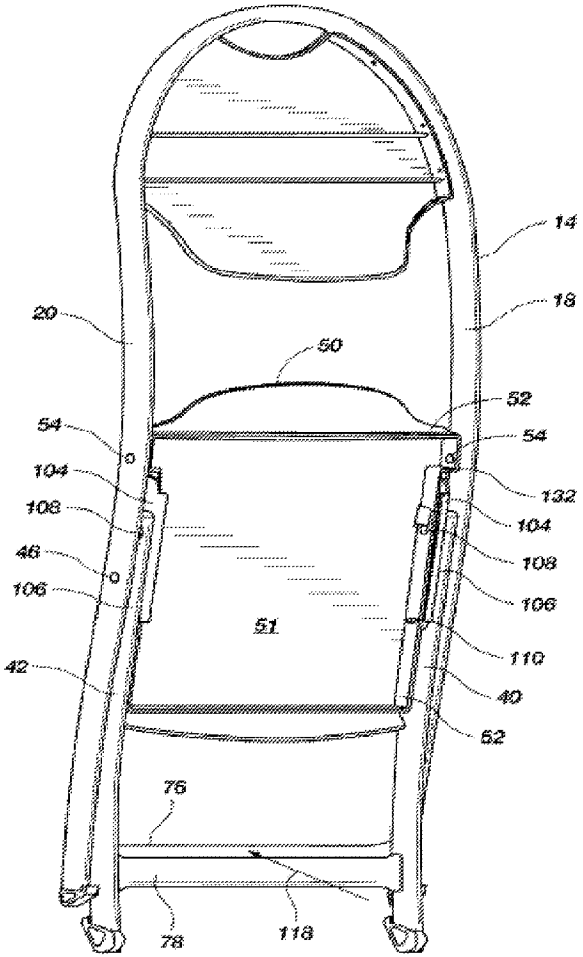
FIG. 1b (Prior art)
FIG. 1 is a prior art illustrating a folding chair having a folding mechanism which collapses or folds upon itself.
Figure 1A:
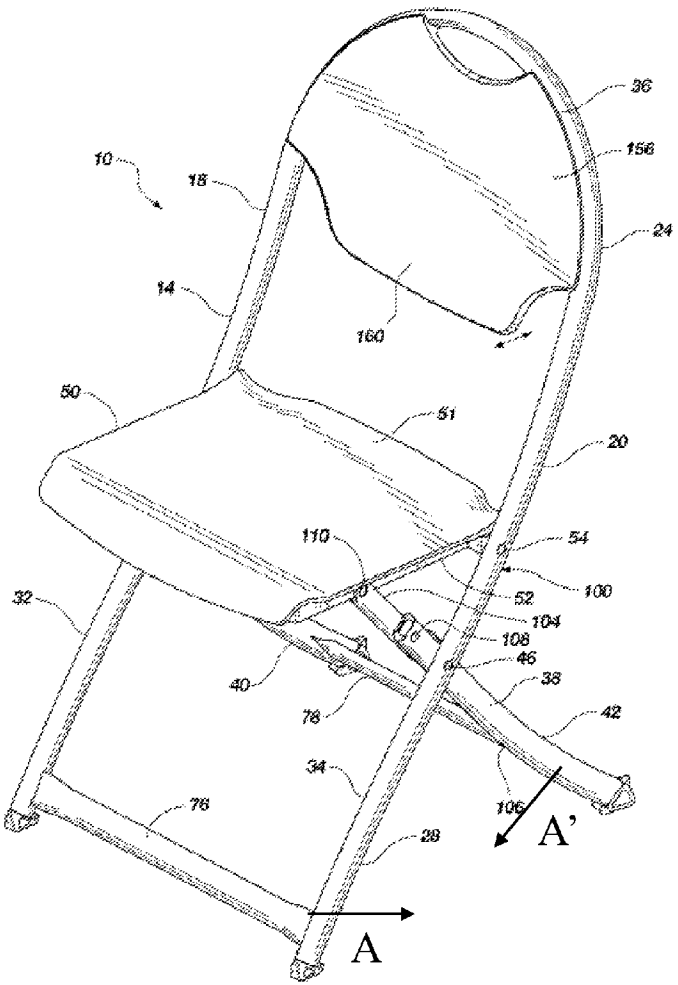
FIG. 1a (Prior art)
Figure 2B:
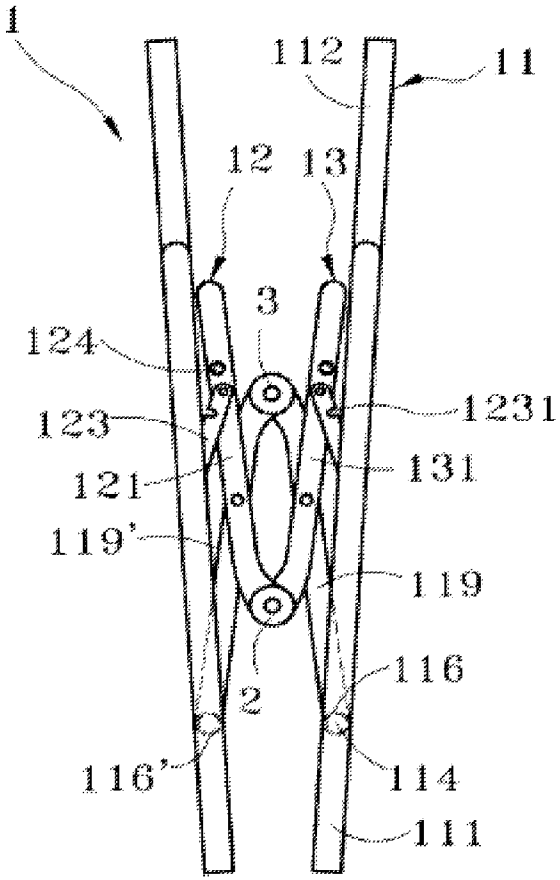
FIG. 2b (Prior art)
FIG. 2 is a prior art illustrating a folding chair that has toggle joints to engage various elements and to function as fulcrums that allow the elements to fold closely with each other.
Figure 2A:
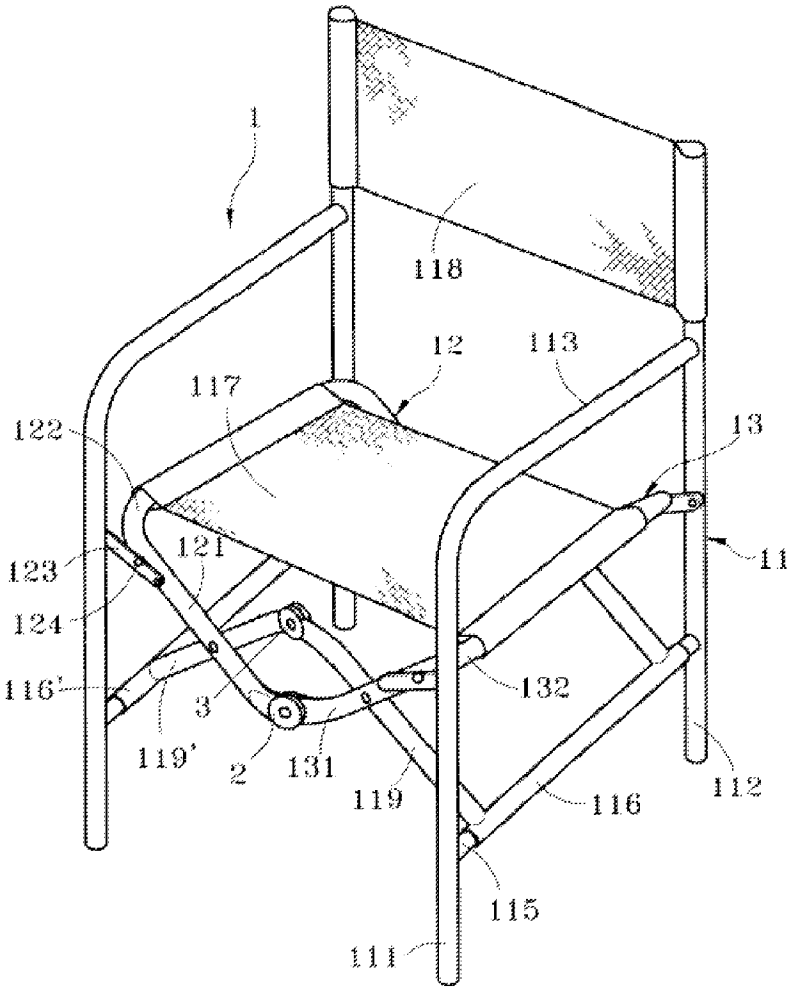
FIG. 2a (Prior art)
Figure 3B:
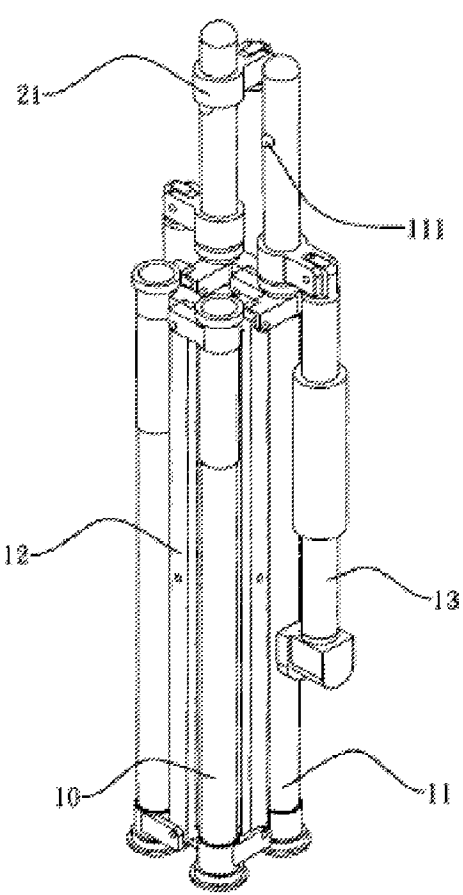
FIG. 3b (Prior art)
FIG. 3 illustrates a folding chair having a supporting backrest and arm rests.
Figure 3A:
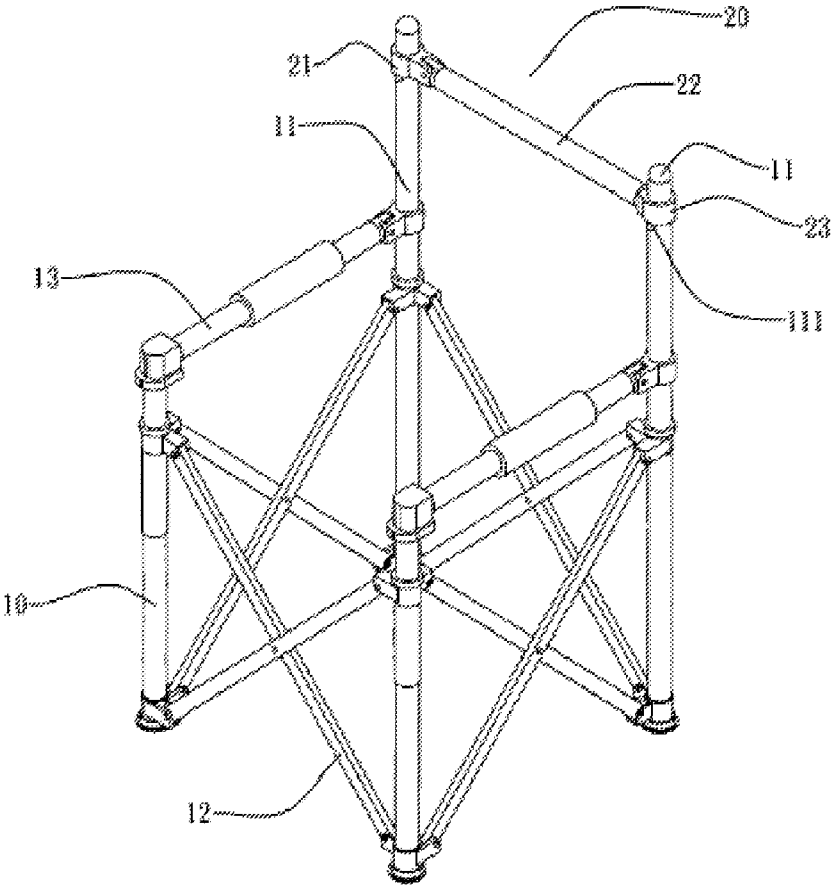
FIG. 3a (Prior art)
Figure 4:
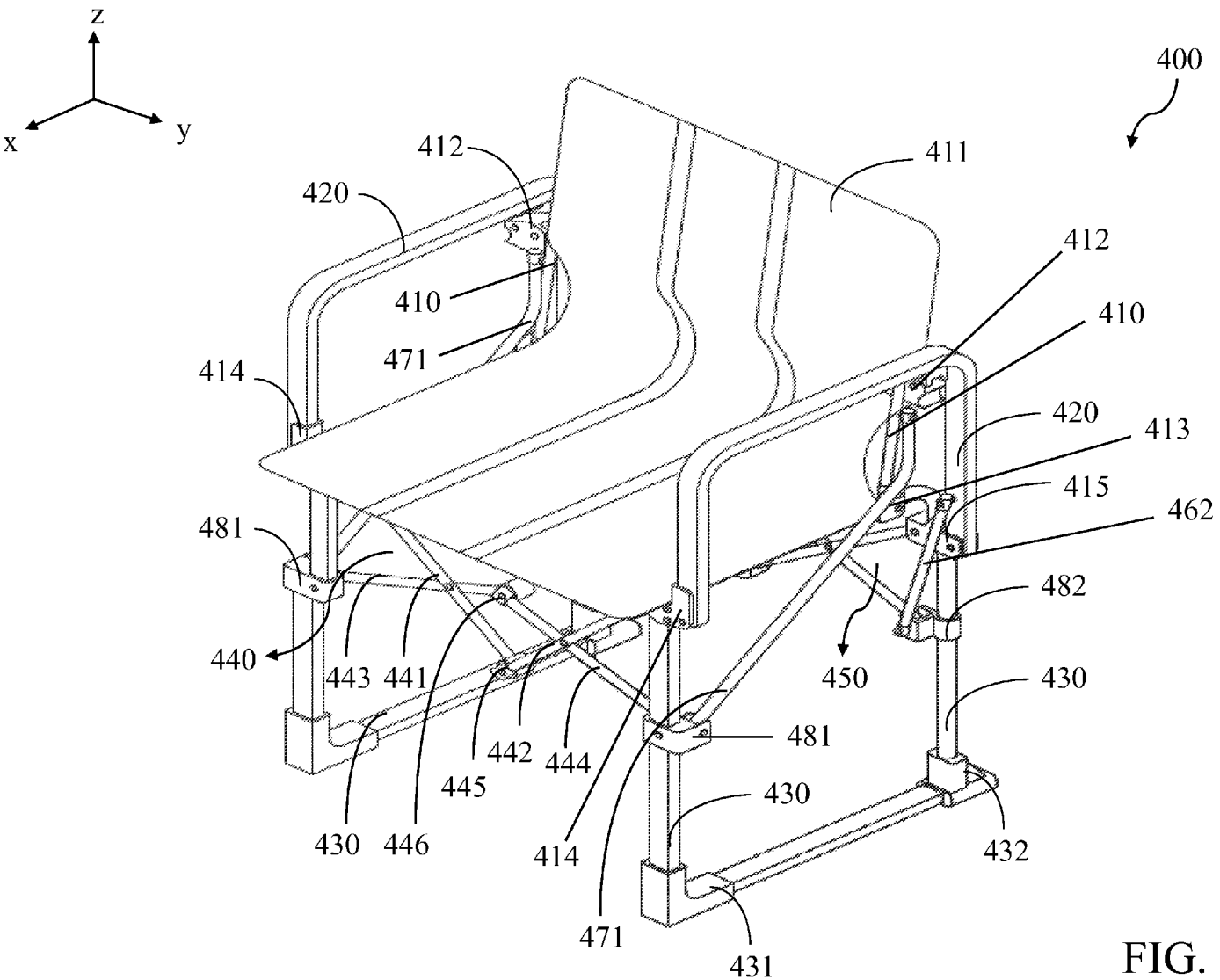
FIG. 4 illustrates a folding chair proposed in the present invention.
Figure 4A:
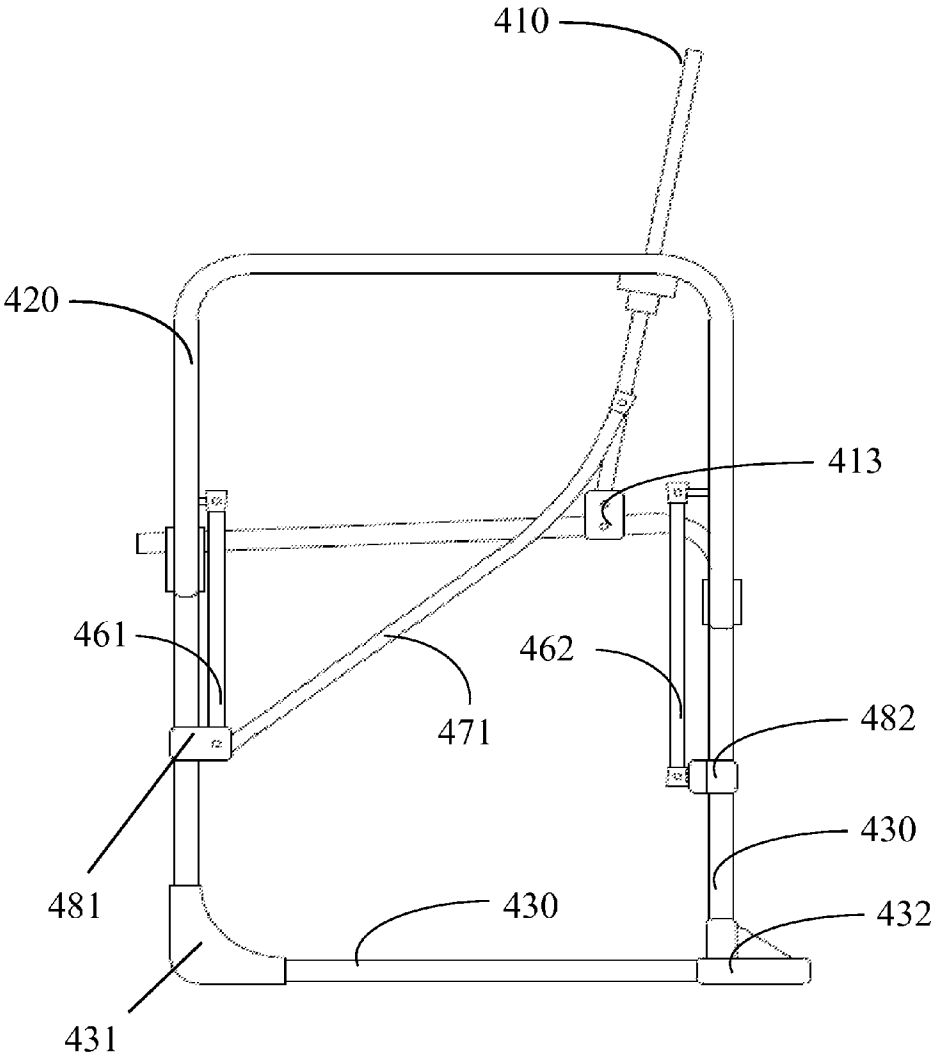
FIGS. 4*a* and 4*b* illustrate a lateral view and a rear view of the folding chair in the present invention shown in FIG. 4.
Figure 4B:
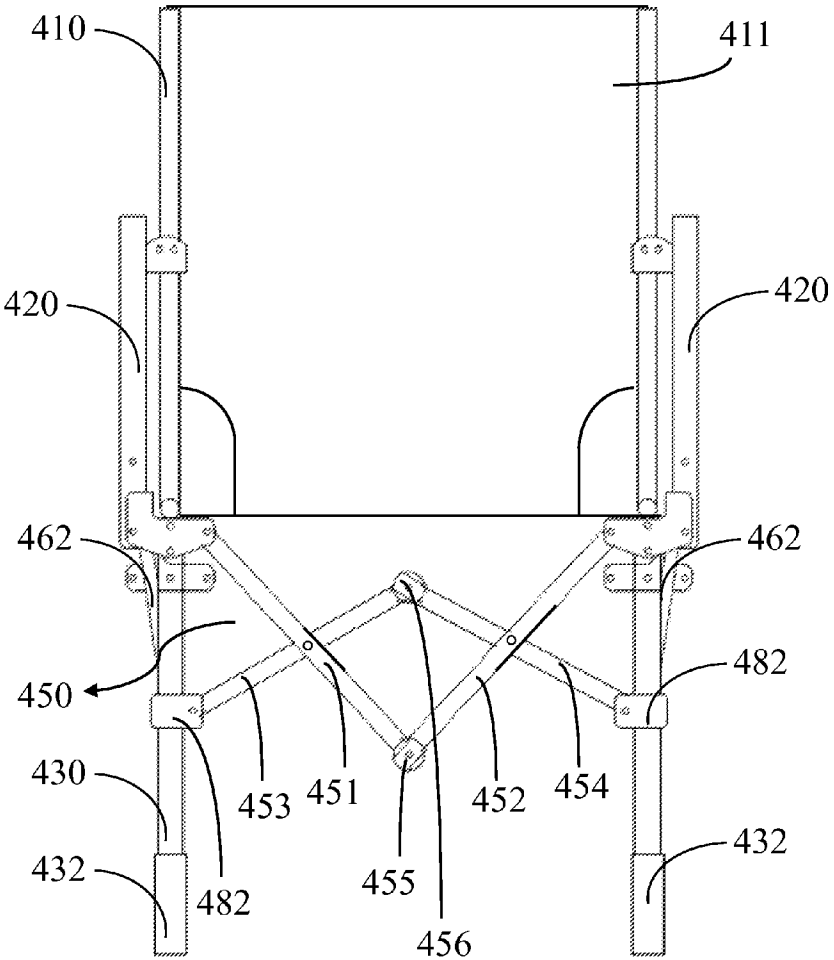
Figure 4C:
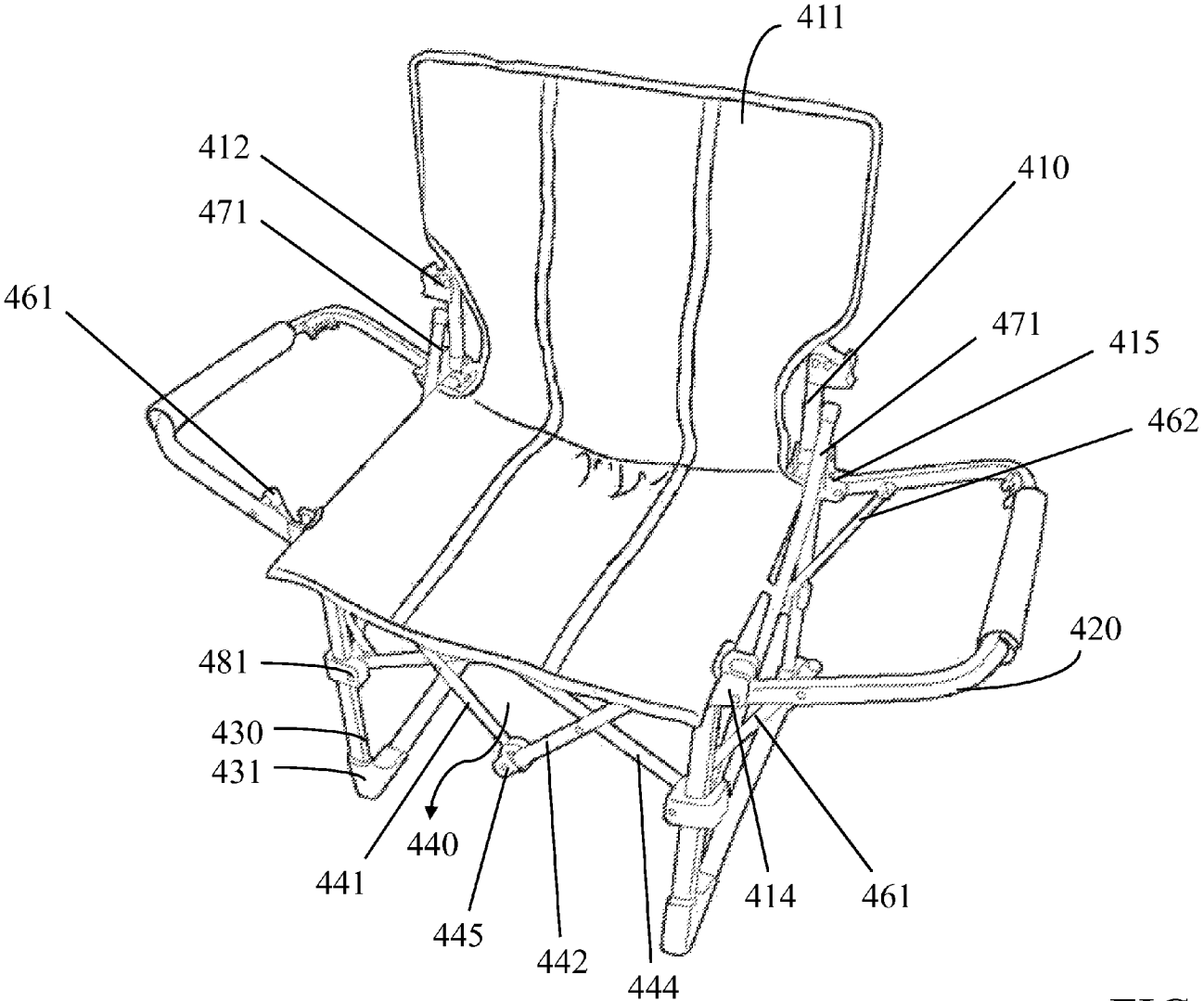
FIGS. 4*c* and 4*d* illustrate a folding mechanism of the folding chair in the present invention.
Figure 4D:
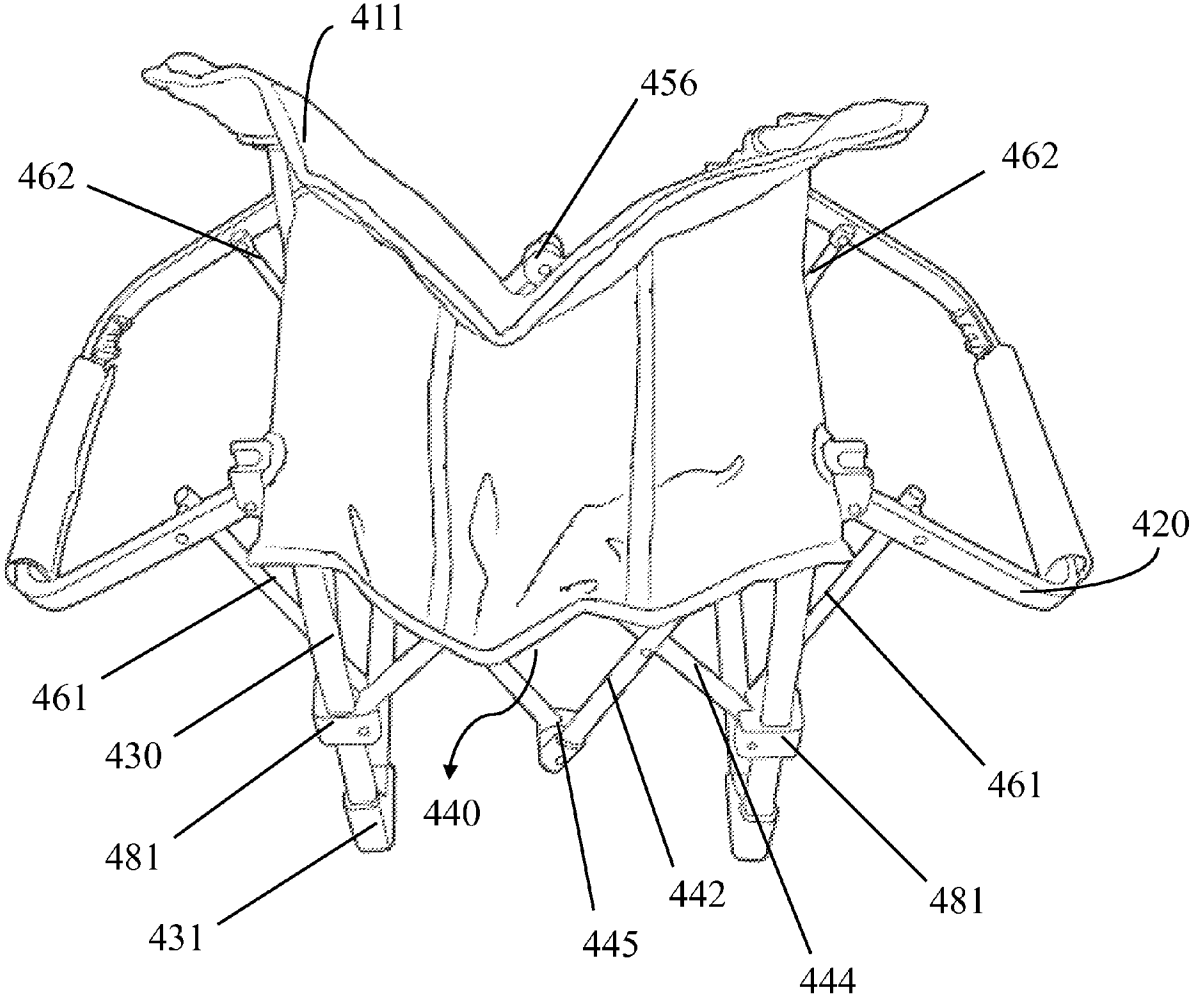
Figure 4E:
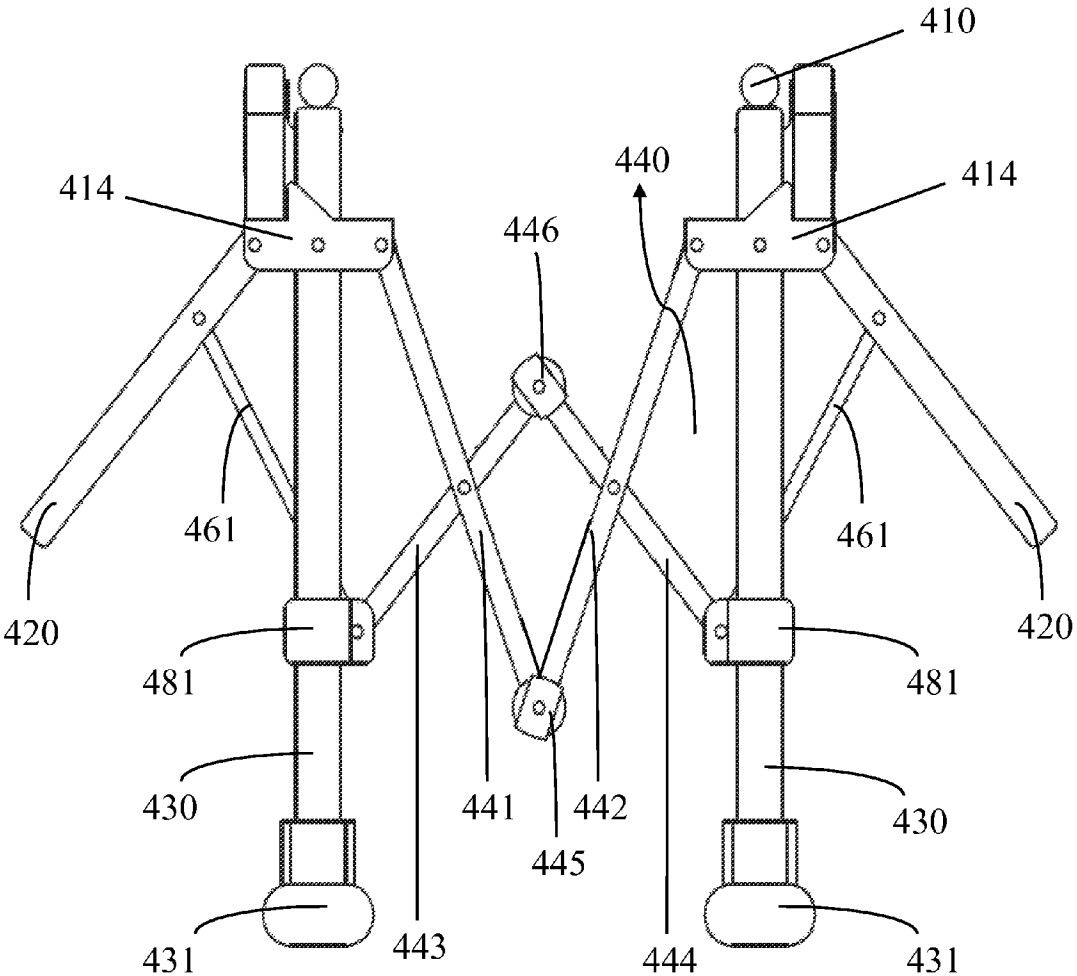
FIGS. 4*e* and 4*f* illustrate a front view of the front linking unit during the folding process in the present invention.
Figure 4F:
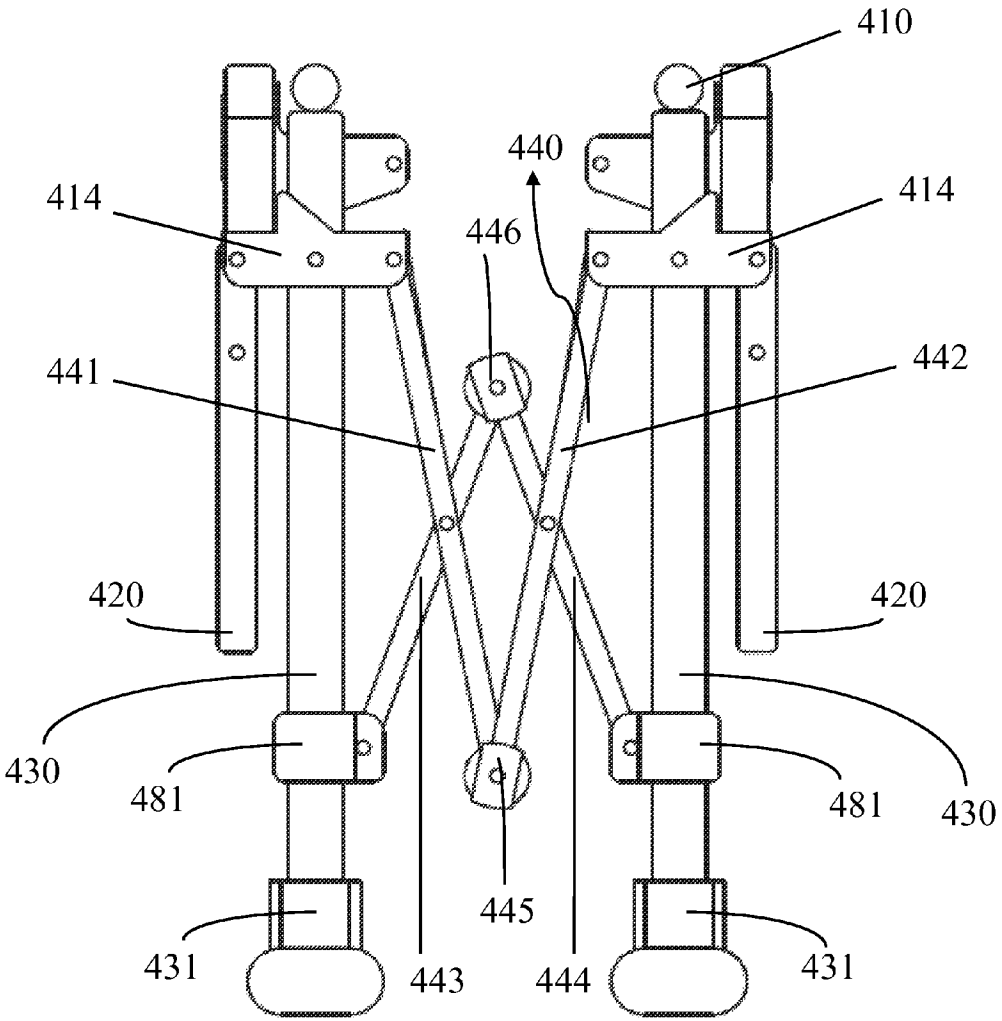

In order to further understand the goal, characteristics and effect of the present invention, a number of embodiments along with the drawings are illustrated as following:

Referring to FIG. 4, a folding chair 400 includes an upper frame 410, two armrests 420, two juxtaposed side frames 430, a front linking unit 440 and a rear linking unit 450. The upper frame 410 and the side frames 430 are coupled through a plurality of connectors 413. More particularly, one end of the connector 413 is fixed at the side frames 430 and the other end is pivotally connected with the upper frame 410, so that the upper frame 410 can move along a "z to x" direction or vice versa on top of the side frames 430. The armrests 420 are also coupled with the side frames 430 through a plurality of armrest connectors. In one embodiment, two front armrest connectors 414 are disposed at front portions of the side frames 430 to engage two front ends of the armrests 420, while two rear armrest connectors 415 are disposed at rear portions of the side frames 430 to engage two rear ends of the armrests 420. Likewise, the armrests 420 are pivotally connected with the side frames 430, so that the armrests 420 can move along a "z to y" direction or vice versa. The upper frame 410 and an upper portion of the side frames 430 are covered by a fabric 411, which is provided as a backrest on the upper frame 410 and a seat on the upper portion of the side frames 430. It is noted that a pair of fasteners 412 are disposed at a predetermined position on the upper frame 410 to secure the armrests 420 and avoid further movement thereof.

The side frames 430 are connected through the front linking unit 440 and the rear linking unit 450, as can be seen in FIGS. 4, 4*b* to 4*d*. The front linking unit 440 includes two first front linking rods (441, 442), a first front connector 445, two second front linking rods (443, 444) and a second front connector 446. The first front linking rods (441, 442) are pivotally connected through the first front connector 445 at one end, and pivotally connected through the front armrest connectors 414 at the other end to form a substantially "V" shaped structure. Similarly, the second front linking rods (443, 444) are pivotally connected through the second front connector 446 at one end, and pivotally connected through two front movable connectors 481 at the other end to form a substantially reverse "V" shaped structure. Furthermore, the "V" shaped structure is also pivotally connected with the reverse "V" shaped structure. More particularly, the first front linking rods (441, 442) are pivotally connected with the second front linking rods (443, 444) at nearly the center of the first and second front linking rods.

Likewise, the rear linking unit 450 includes first rear linking rods (451, 452), a first rear connector 455, second rear linking rods (453, 454) and a second rear connector 456. The first rear linking rods (451, 452) are pivotally connected through the first rear connector 455 at one end, and pivotally connected through the rear armrest connectors 415 at the other end to form a substantially "V" shaped structure. The second rear linking rods (453, 454) are pivotally connected through the second rear connector 456 at one end, and pivotally connected through two rear movable connectors 482 at the other end to form a substantially reverse "V" shaped structure. Similarly, the first rear linking rods (451, 452) are also pivotally connected with the second rear linking rods (453, 454) at nearly the center of the first and second rear linking rods.

As can be seen in FIGS. 4, 4*a* to 4*g*, the folding chair 400 also includes a pair of front connecting rods 461, a pair of rear connecting rods 462 and a pair of side connecting rods 471. The front connecting rods 461 are pivotally connected with front portion of the armrest 420 at one end, and pivotally connected with the front movable connectors 481 at the other end. Likewise, the rear connecting rods 462 are pivotally connected with rear portion of the armrest 420 at one end, and pivotally connected with the rear movable connectors 482 at the other end. The side connecting rods 471 are connected with the upper frame 410 at one end, and connected with the front movable connectors 481 at the other end.

When the user wishes to fold the folding chair 400 in FIG. 4, the user can first unfasten the armrests 420 from the fasteners 412. As can be seen in FIGS. 4*c* to 4*f*, when the armrests 420 moves down, the front linking unit 440 and rear linking unit 450 start to shrink to bring the side frames 430 closer to each other. In the mean time, the side connecting rods 471 are driven to bring the upper frame 410 to moves down and further squeeze the fabric 411 into a space between two side frames 430 to form a compact structure of the folding chair 400 shown in FIG. 4*g*.

More particularly, as can be seen in FIGS. 4, and 4*b* to 4*f*, since the front connecting rods 461 and rear connecting rods 462 are pivotally connected with the armrests 420 at one end, and pivotally connected to the front movable connector 481 and rear movable connector 482 respectively at the other end, when the armrests 420 move down to start the chair folding process, the front (461) and rear (462) connecting rods are driven by the armrest 20 to push down the front (481) and rear (482) movable connectors respectively to further trigger the downward movements of the second front linking rods (443, 444 connected by the second front connector 446) and the second rear linking rods (453, 454 connected by the second rear connector 456) to gradually shrink the size thereof. Also, as stated above, the second front linking rods (443, 444) and the second rear linking rods (453, 454) are pivotally connected with the first front linking rods (441, 442 connected by the first front connector 445) and first rear linking rods (451, 452 connected by the first rear connector 456) respectively, so when the second front linking rods (443, 444) and the second rear linking rods (453, 454) are driven to move downward to shrink the size, the first front linking rods (441, 442) and first rear linking rods (451, 452) are actuated to shrink the size thereof respectively as well. Namely, when the armrests 420 are moved down to start the chair folding process, the front linking unit 440 and the rear linking unit 450 are triggered to shrink the sizes to bring the side frame 430 closer to each other.

Figure 4G:
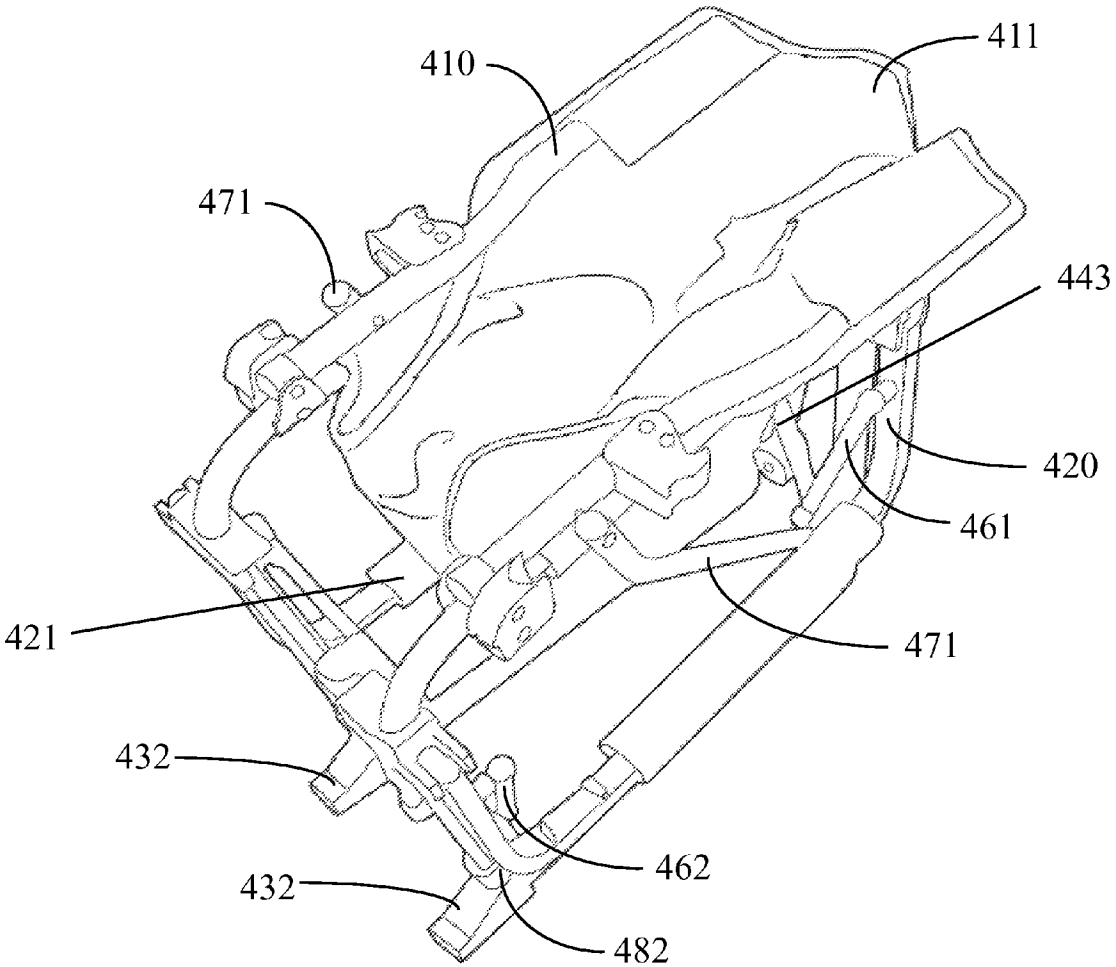
FIG. 4*g* illustrates a folded chair with a compact size in the present invention.

In addition, when the armrests 420 move down to simultaneously push down the front movable connector 481, the side connecting rods 471 are also actuated to bring the upper frame 410 forward (from z to x direction, see FIG. 4) to eventually dispose on the side frames 430, and the fabric 411 are forced to fold within the side frames 430 to form a compact folding chair structure as shown in FIG. 4*g*.

Summarily, the distance of the side frames 430, namely the width of the folding char 400, can be determined by the length of the front linking unit 440 and rear linking unit 450. When the chair is in use, the front linking unit 440 and rear linking unit 450 are fully extended to separate the side frames 430 and tighten the fabric 411 to form a seat and a backrest. On the other hand, when the armrests 420 move down to start the chair folding process, the front linking unit 440 and rear linking unit 450 start to shrink until the armrests 420 move down nearly 180 degrees, and the distance between two side frames 430 are nearly the minimum length of the front linking unit 440 and rear linking unit 450. Meanwhile, the upper frame 410 is brought down to the side frames 430 along with the fabric to form a compact and portable folding chair.

On the other hand, the folding chair 400 shown in FIG. 4*g* can be easily unfolded to form a chair structure shown in FIG. 4. The user may have to start with lifting the armrests 420, which would trigger the front (461) and rear (462) connecting rods to bring up the front (481) and rear (482) movable connectors. With the upward movements of the front (481) and rear (482) movable connectors, the front linking unit 440 and rear linking unit 450 can be gradually extended and eventually reach their most extendable length. Meanwhile, the side connecting rods 471 are also triggered by the upward movements of the front (481) and rear (482) movable connectors to lift the upper frame 410 to the upright position and the fabric 411 is tightened to form the backrest and seat on the upper frame 410. Finally, the armrests 420 are fastened at the upper frame 410 by the fasteners 412. It is noted that in order to protect the lower portion of the side frames 430, a plurality of protectors (431, 432) may be disposed at the foot portion of the side frames 430.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A folding chair comprising:

two side frames that are movable and juxtaposed with each other;

an upper frame that is covered by a fabric to form a backrest and a seat, and disposed on top of two juxtaposed side frames, and pivotally connected with the side frames through a plurality of connectors;

two armrests pivotally connected with the side frames through a plurality of armrest connectors; and a front linking unit and a rear linking unit that are pivotally connected to the armrests and the side frames;

wherein when the armrests are downwardly pushed away from the upper frame to start a semicircular movement to fold the chair, the front linking unit and the rear linking unit start to shrink to bring the side frames closer to each other, and the upper frame is driven by the armrest to move down and further squeeze the fabric into a space between two side frames to form a compact structure of the folding chair.

2. The folding chair of claim 1, wherein the front linking unit includes two first front linking rods, a first front connector, two second front linking rods and a second front connector, and the first front linking rods are pivotally connected through the first front connector at one end, while the second front linking rods are pivotally connected through the second front connector at one end; and wherein the rear linking unit includes two first rear linking rods, a first rear connector, two second rear linking rods and a second rear connector, and the first rear linking rods are pivotally connected through the first rear connector at one end, while the second rear linking rods are pivotally connected through the second rear connector at one end.

3. The folding chair of claim 2, wherein the first front linking rods are pivotally connected to two front armrest connectors at the other end to form a substantially "V" shaped structure, while the second front linking rods are pivotally connected to two front movable connectors at the other end to form a substantially reverse "V" shaped structure; and wherein the second rear linking rods are pivotally connected to two rear armrest connectors at the other end to form a substantially "V" shaped structure, while the second rear linking rods are pivotally connected to two rear movable connectors at the other end to form a substantially reverse "V" shaped structure.

4. The folding chair of claim 3, wherein the first front linking rods are pivotally connected with the second front linking rods at nearly center portion of the first and second front linking rods; and wherein the first rear linking rods are pivotally connected with the second rear linking rods at nearly center portion of the first and second rear linking rods.

5. The folding chair of claim 4, wherein a pair of front connecting rods are pivotally connected with front portion of the armrest at one end, and pivotally connected with the front movable connectors at the other end; and wherein a pair of rear connecting rods are pivotally connected with rear portion of the armrest at one end, and pivotally connected with the rear movable connectors at the other end.

6. The folding chair of claim 5, wherein when the armrests are moved down, the front and rear connecting rods are driven by the armrest to push down the front and rear movable connectors respectively to drive the second front linking rods and the second rear linking rods to move down and actuate the first front linking rods and first rear linking rods respectively to further shrink the front linking unit and the rear linking unit to a compact size.

7. The folding chair of claim 6, further comprising a pair of side connecting rods connected with the upper frame at one end, and connected with the front movable connectors at the other end.

8. The folding chair of claim 7, wherein the side connecting rods are used to bring the upper frame down to the side frame when the front movable connectors are driven to move down.

9. The folding chair of claim 8, wherein the upper frame is allowed to move 180 degrees above the side frames.

10. The folding chair of claim 9, wherein the size of the folding chair is determined by extended length of the front linking unit and a rear linking unit.

11. The folding chair of claim 10, further comprising a fastener disposed at the upper frame to fasten the armrest.

12. The folding chair of claim 1, further comprising a pair of side connecting rods connected with the upper frame at one end, and connected with the front movable connectors at the other end.

13. The folding chair of claim 1, wherein the upper frame is allowed to move 180 degrees above the side frames.

14. The folding chair of claim 1, wherein the size of the folding chair is determined by extended length of the front linking unit and a rear linking unit.

15. The folding chair of claim 1, further comprising a fastener disposed at the upper frame to fasten the armrest.

* * * * *